US008080134B2

(12) United States Patent
Huang

(10) Patent No.: US 8,080,134 B2
(45) Date of Patent: Dec. 20, 2011

(54) APPARATUS FOR MAKING A COMPOSITE BLIND SLAT

(75) Inventor: Shih-Chang Huang, Fusing Township, Changhua County (TW)

(73) Assignee: Taicang Kingfu Plastic Manufacture Co., Ltd., Taicang (CN)

( * ) Notice: Subject to any disclaimer, the term of this patent is extended or adjusted under 35 U.S.C. 154(b) by 0 days.

(21) Appl. No.: 12/844,286

(22) Filed: Jul. 27, 2010

(65) Prior Publication Data

US 2011/0186255 A1 Aug. 4, 2011

(30) Foreign Application Priority Data

Jan. 29, 2010 (CN) ..... 2010 2 0114140 U

(51) Int. Cl.
*D21H 11/00* (2006.01)

(52) U.S. Cl. ..... 162/265

(58) Field of Classification Search ..... 162/265; 160/236; 264/137; 425/374, 384, 392, 394
See application file for complete search history.

(56) References Cited

U.S. PATENT DOCUMENTS

2006/0110490 A1* 5/2006 Nien ..... 425/392
2011/0186244 A1* 8/2011 Huang ..... 160/236
* cited by examiner

*Primary Examiner* — Mark Halpern
(74) *Attorney, Agent, or Firm* — Osha • Liang LLP

(57) ABSTRACT

An apparatus for making blind slats includes: a feeding unit adapted to feed a pulp fiber web; an impregnation tank containing an impregnating liquid for impregnating the pulp fiber web; a conveying roller assembly disposed within said impregnation tank for immersing and conveying the pulp fiber web through the impregnating liquid; and a thermal forming unit for thermal forming the pulp fiber web that has been impregnated.

7 Claims, 6 Drawing Sheets

APPARATUS FOR MAKING A COMPOSITE BLIND SLAT

CROSS-REFERENCE TO RELATED APPLICATION

This application claims priority of Chinese Patent Application No. 201020114140.9 filed on Jan. 29, 2010.

BACKGROUND OF THE INVENTION

1. Field of the Invention

The invention relates to a Venetian blind, more particularly to an apparatus for making a composite blind slat of a Venetian blind.

2. Description of the Related Art

Early blind slats are made from thin metal plates, such as by forming thin aluminum or ion plates into curved plates of arcuate cross-section, followed by coating the surfaces of the curved plates. Such metallic blind slats are expansive, heavy, and inconvenient and have poor thermal insulation properties. In order to address the drawbacks of the metallic blind slats, the metallic blind slats have been replaced by plastic slats, such as PVC slats which are lighter and easier to operate. However, because PVC can not be recycled and decomposed biologically, it is an increasing trend to prohibit PVC products in most countries in the world. Many attempts have been made to seek environment conserving substitutes for PVC blind slats. For example, the applicant of the present invention proposed a method of making blind slats using recycled fly ash as a major material. However, the fly ash blind slats are not widely accepted as they are heavy and inconvenient to handle. Therefore, there is a need of blind slats that are environmentally friendly and that can be handled conveniently.

SUMMARY OF THE INVENTION

Therefore, a main object of the present invention is to provide an apparatus for making a composite blind slat from an environmentally friendly pulp fiber web.

According to the present invention, an apparatus for making blind slats comprises: a feeding unit adapted to feed a pulp fiber web; an impregnation tank disposed downstream of the feeding unit and containing an impregnating liquid for impregnating the pulp fiber web; a conveying roller assembly disposed within the impregnation tank for immersing and conveying the pulp fiber web within the impregnation tank; and a thermal forming unit disposed downstream of the impregnation tank for thermal forming the pulp fiber web that has been impregnated. The thermal forming unit has at least one forming channel with an arcuate cross section adapted to shape the pulp fiber web.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
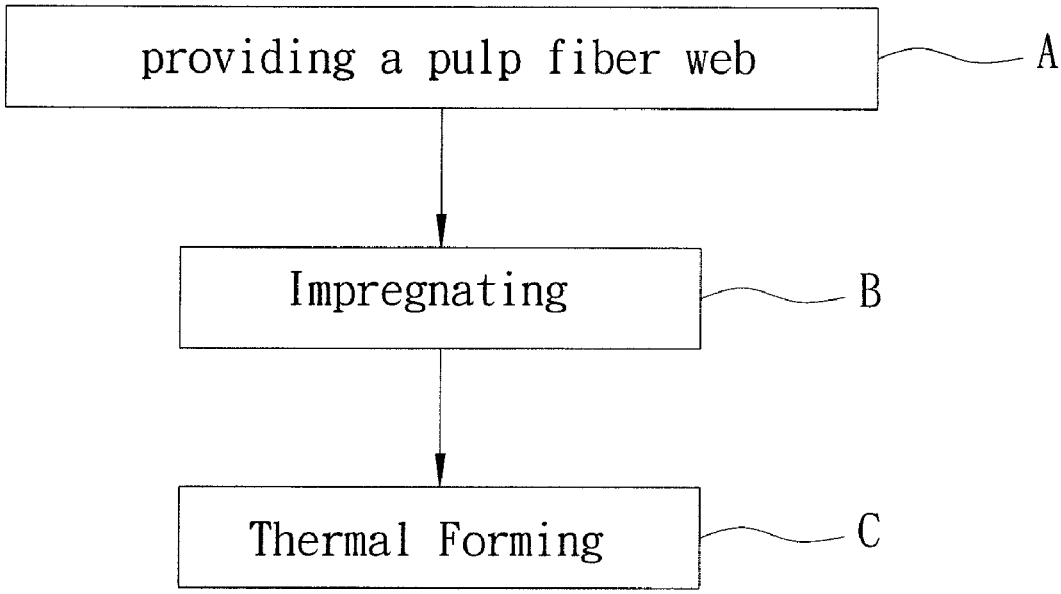
FIG. 1 is a flow diagram illustrating a method of making composite blind slats according to a preferred embodiment of the present invention.
Figure 5:
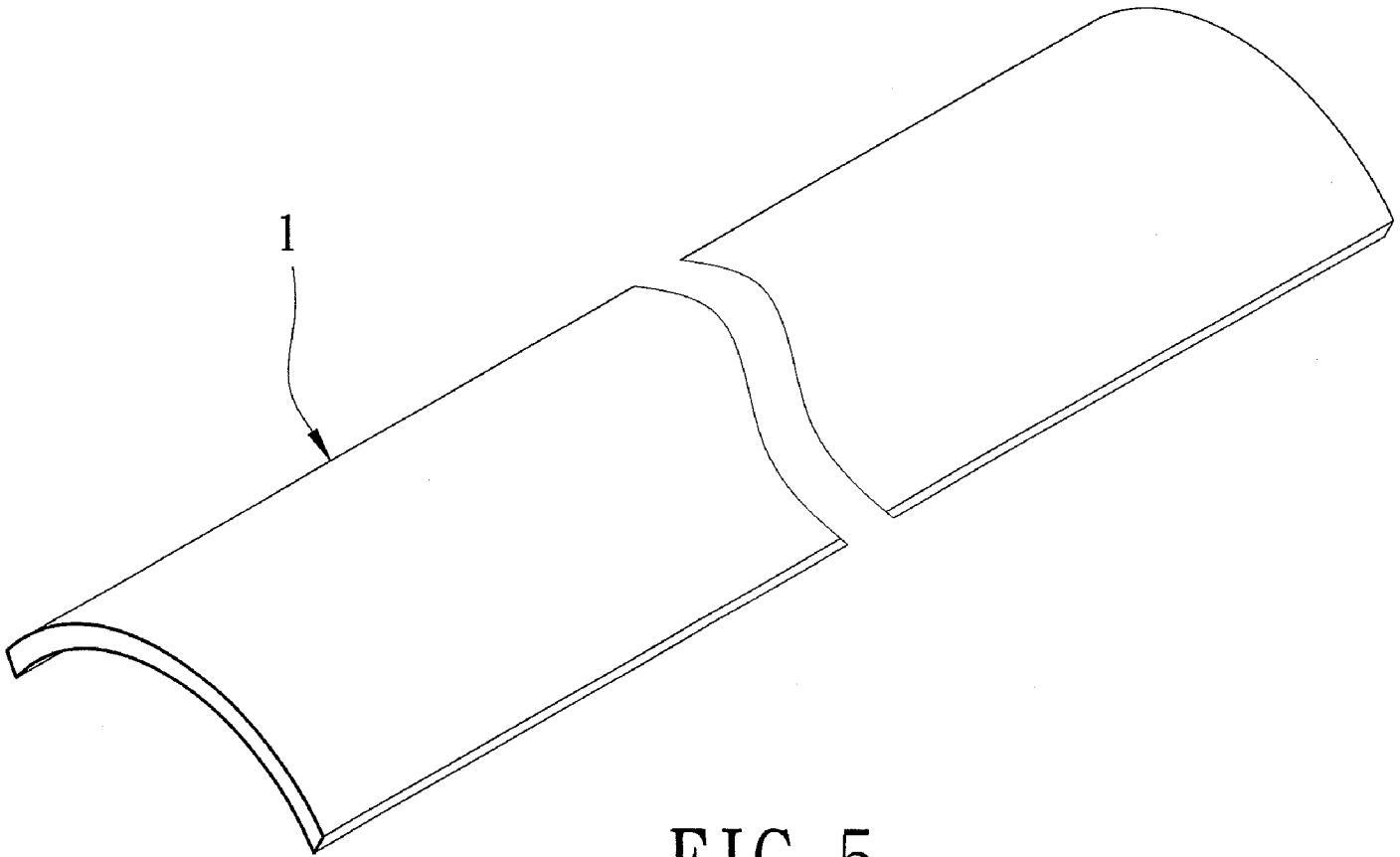
FIG. 5 is a perspective view of the composite blind slat made by the present invention.
Figure 6:
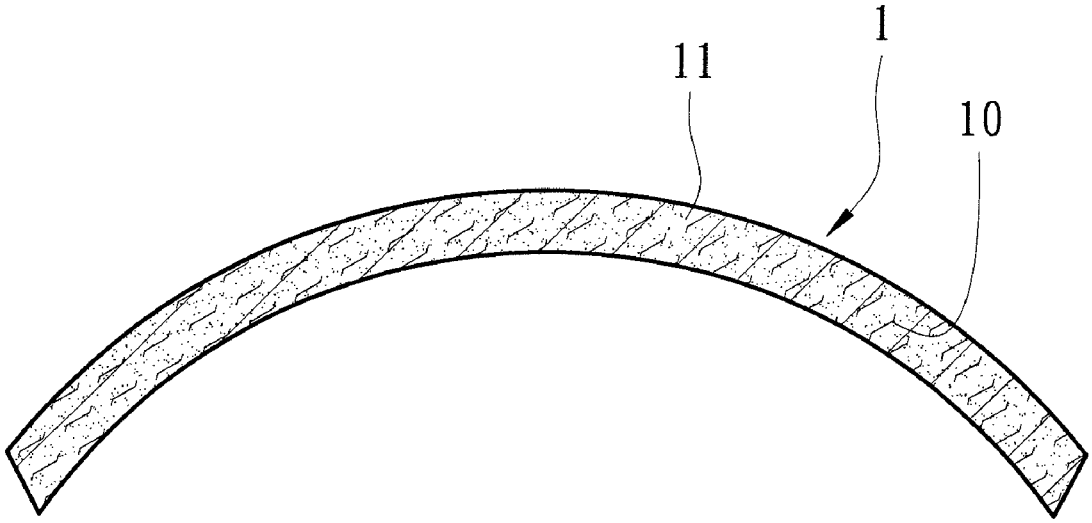
FIG. 6 is a sectional view of the composite blind slat of FIG. 5.

Referring to FIGS. 1, 5 and 6, a method of making a composite blind slat 1 according to the present invention includes: (A) providing a pulp fiber web; (B) impregnating the pulp fiber web with an aqueous dispersion that contains styrene-octyl acrylate copolymer, and water; and (C) thermal forming the pulp fiber web that has been impregnated.

The composite blind slat 1 includes a pulp fiber web 10, and a polyacrylate resin 11 impregnating the pulp fiber web 10.

Figure 2:
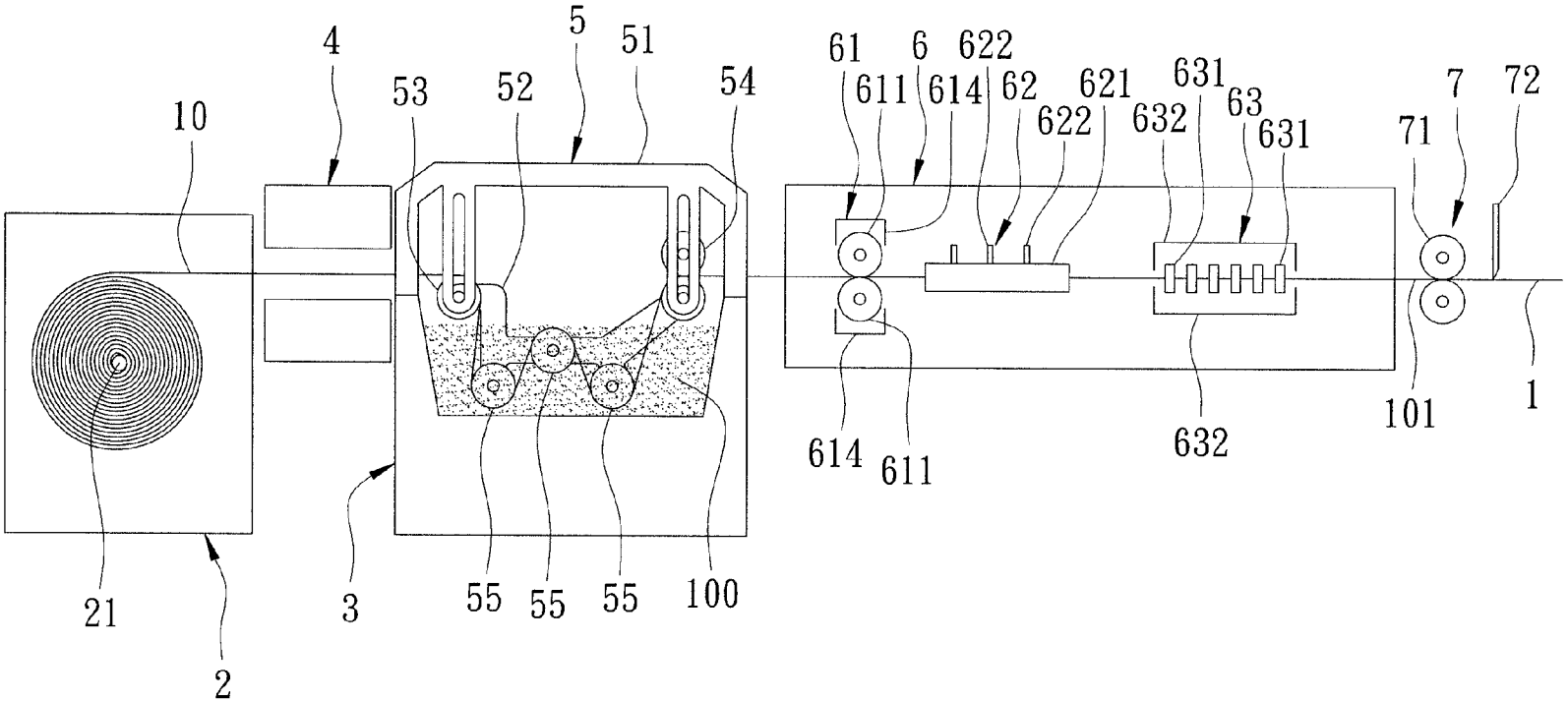
FIG. 2 is a schematic view illustrating an apparatus for making composite blind slats according to a preferred embodiment of the present invention.
Figure 3:
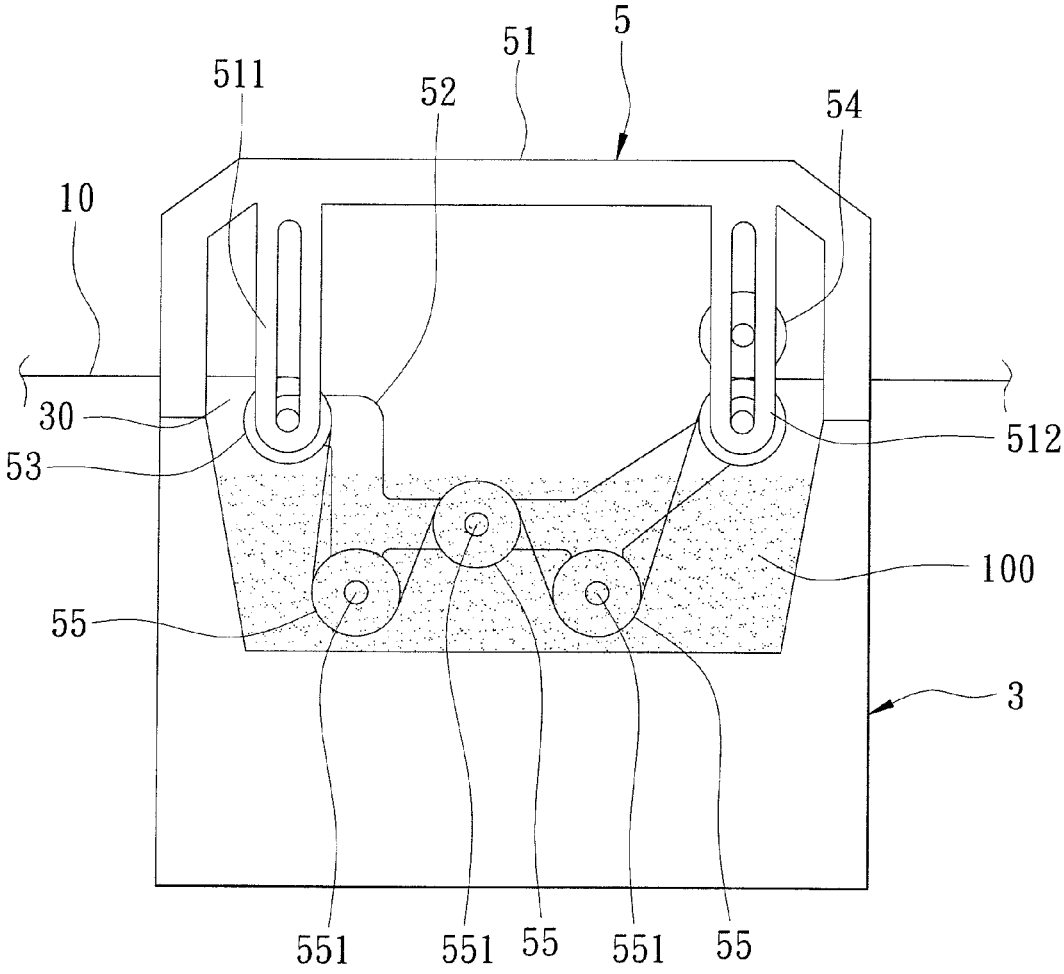
FIG. 3 is a schematic view showing an impregnation tank of the apparatus of FIG. 2.
Figure 4:
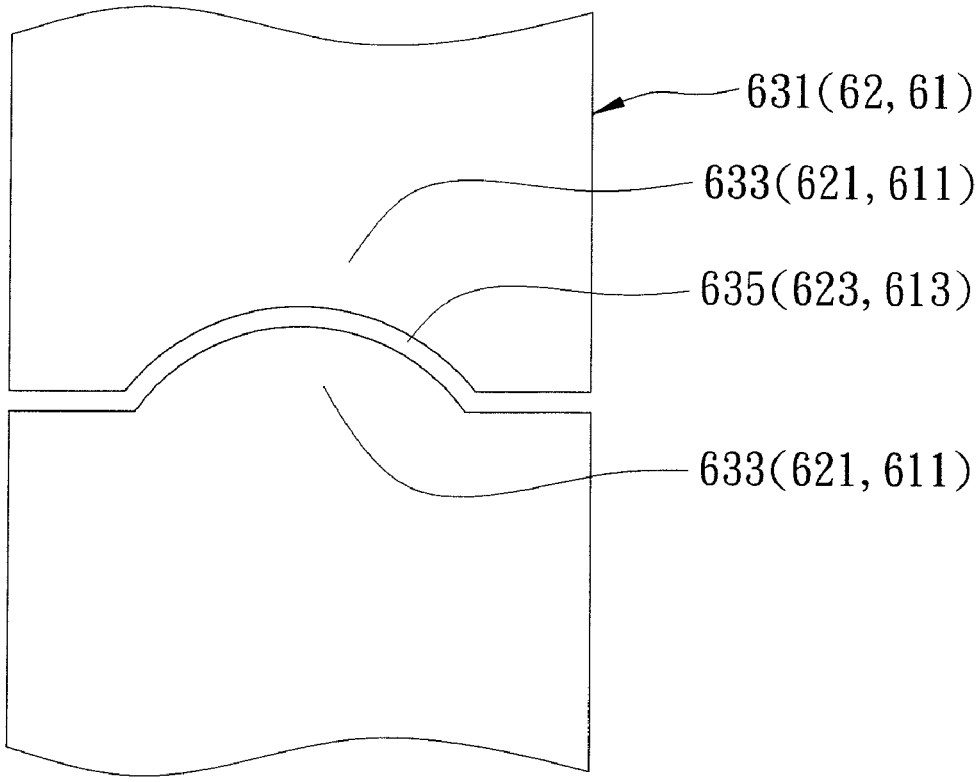
FIG. 4 is a schematic view showing a forming channel of the apparatus of FIG. 2.

Referring to FIGS. 2, 3 and 4, there is shown an apparatus for making the composite blind slats 1 according to the present invention. The apparatus includes a feeding unit 2, an impregnation tank 3, a heating unit 4, an advancing roller assembly 5, a thermal forming unit 6, and a cutting unit 7. In a preferred embodiment, the apparatus is used to conduct the method according to the present invention. The apparatus and the method are described hereinafter.

The feeding unit 2 has a reel 21 mounted on a frame (not shown), and a continuous pulp fiber web 10 is wound around the reel 21. The pulp fiber web 10 may be made from any pulp commonly used in making paper, such as ground wood pulp, chemical pulp, semi-chemical pulp, or a waste paper pulp recycled from waste paper. Preferably, the pulp fiber web 10 is made from the waste paper pulp so that waste paper can be recycled. The thickness of the pulp fiber web 10 is preferably 0.5-5 mm.

The conveying roller assembly 5 is disposed in the impregnation tank 3 downstream of the feeding unit 2. The impregnation tank 3 contains an impregnating liquid 100 for impregnating the pulp fiber web 10. The impregnation tank 3 has a mount 51 that is disposed on top of the impregnation tank 3 and that has two downwardly extending hanging arms 511, 512, and a roller frame 52 having two ends hung on the hanging arms 511, 512 of the mount 51 and extending into the impregnating liquid 100.

The conveying roller assembly 5 has a draw roll 53 connected to the hanging arm 511 and the roller frame 52, a pair of squeeze rolls 54 connected to the hanging arm 512 and the roller frame 52, and three guide rolls 55 attached to the roller frame 52. The draw roll 53 is proximate to an upstream side of the impregnation tank 3, and the squeeze rolls 54 are proximate to a downstream side of the impregnation tank 3.

The pulp fiber web 10 from the feeding unit is passed through the heating unit 4, and the conveying roller assembly 5 directs the pulp fiber web 10 into the impregnation tank 3 where the pulp fiber web 10 is immersed in the impregnating liquid 100.

The impregnating liquid 100 includes an aqueous dispersion that includes styrene octylacrylate copolymer and water in a predetermined ratio. The aqueous dispersion of the impregnating liquid 100 has high permeating properties so that, when the pulp fiber web 10 is immersed in the impregnating liquid 100, the aqueous dispersion can readily penetrate the pores of the pulp fiber web 10. In an example, the impregnating liquid 100 is prepared by mixing water with styrene octylacrylate copolymer which is a commercial product, DM-346, manufactured by Nan Pao Resins Chemical Co., Ltd. The specification of DM-346 is shown in Table 1.

TABLE 1

| | |
|---|---|
| Appearance | milk white |
| Viscosity* | 20-100 cps |
| pH value | 6.0-7.0 |
| Solid content | 45 ± 2% |
| Composition | Styrene-octylacrylate copolymer emulsion |

Note:
Viscosity* is measured by a method using an LVT type viscometer, No. 2 shaft, a speed of 60 r.p.m. and a temperature below 25° C.

The styrene-octylacrylate copolymer has the following properties: (1) The copolymer has a low average molecular weight and strong penetrating ability, and can penetrate uniformly into the pulp fiber web 10 so that no shell-like surface resin phenomenon occurs; (2) The copolymer has excellent adhesion to the pulp fiber web 10 and thus can provide the impregnated pulp fiber web 10 with high stiffness sufficient to prevent the blind slats formed from the impregnated pulp fiber web from slacking; (3) The copolymer permits the impregnated pulp fiber web 10 to be dyed or colored readily and uniformly without incurring uneven dying problem; (4) The copolymer is cheap and the properties thereof is comparable with those of melamine resin; and (5) The copolymer does not contain formalin and thus is of low toxicity and safe.

The ratio of styrene-octylacrylate copolymer to water in the impregnation liquid 100 can be adjusted according to a desired level of impregnation, and may ranges from 0.5/1 to 5/1. If it is necessary to increase further the penetrating ability of the impregnation liquid 100, a predetermined amount of isopropanol may be added to the mixture of styrene octylacrylate copolymer and water.

After the pulp fiber web 10 is immersed until it is saturated with the impregnating liquid 100, the impregnated pulp fiber web 10 is passed between the squeeze rolls 54 where excessive liquid is removed from the impregnated pulp fiber web 10. While impregnation is carried out by immersion in this embodiment, it is possible to use other impregnation methods, such as by spraying or applying the impregnating liquid 100 to the pulp fiber web 10 repeatedly until the pulp fiber web 10 is saturated with the impregnating liquid 100.

The thermal forming unit 6 is disposed downstream of the impregnation tank 33 and is used to form the pulp fiber web 10 that has been impregnated in the impregnation tank 33. The thermal forming section 6 includes a pre-forming device 61, a main forming device 62, and a post-forming device 63. Referring to FIG. 4 in combination with FIG. 2, the pre-forming device 61 has a pair of forming rollers 611, and a set of pre-heaters 614 to heat the forming rollers 611, 612. The main forming device 62 has a pair of mold halves 621, and a plurality of heating elements 622. The post-forming device 63 has a series of forming molds 631 arranged at intervals, and upper and lower heaters 632 to heat the forming molds 631. Each of the forming molds 631 has upper and lower mold halves 633.

Referring once again to FIGS. 1 and 4, the forming rollers 611 of the pre-forming device 61, the mold halves 621 of the main forming device 62, or the mold halves 633 of each forming mold 631 of the post-forming device 63 define therebetween a forming channel 613, 623 or 635 for forming or shaping the impregnated pulp fiber web 10. The forming channels 613, 623 and 635 are arcuate in cross section and are aligned with each other along the advancing direction of the pulp fiber web 10.

In the thermal forming unit 6, the impregnated pulp fiber web 10 exiting from the squeeze rolls 54 is heated and formed by the pre-forming device 61, the main forming device 62 and the post-forming device 63. Since the impregnated pulp fiber web 10 is passed through the arcuate forming channels 613, 623 and 635, it is formed into a continuous blank web 101 having an arcuated cross section. In an embodiment, the temperature used in the thermal forming unit 6 is in the range of 130-150° C., and the duration time is about 5-8 min. The continuous blank web 101 has a predetermined structural strength and stiffness and therefore is not easily deformed.

The cutting section 7 is disposed downstream of the thermal forming unit 6, and includes a set of advancing rollers 71, and a cutter 72. The continuous blank web 101 is fed to the cutter 72 by the advancing rollers 71 and is cut at predetermined intervals to form a plurality of the blind slats 1.

The composite blind slat 1 made according to the present invention is environmentally friendly, resistant to moisture and has a light weight property. In order to increase the function of the composite blind slat 1, one or more functional materials may be added to the impregnating liquid 100 in the impregnation tank, or added to the pulp fiber web 10 during the preparation of the pulp fiber web 10. The functional materials may include an ultraviolet radiation-resisting agent, a flame-retarding agent, etc. When the ultraviolet radiation-resisting agent is added, the durability of the composite blind slat 1 can be increased. The flame-retarding agent can reduce flammability of the composite blind slat 1.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An apparatus for making blind slats, comprising:

a feeding unit adapted to feed a pulp fiber web;

an impregnation tank disposed downstream of said feeding unit and containing an impregnating liquid for impregnating the pulp fiber web;

a conveying roller assembly disposed within said impregnation tank for immersing and conveying the pulp fiber web within said impregnation tank; and a thermal forming unit disposed downstream of the impregnation tank for thermal forming the pulp fiber web that has been impregnated, said thermal forming unit having at least one forming channel with an arcuate cross section adapted to shape the pulp fiber web.

2. The apparatus of claim 1, further comprising a heating unit disposed between said feeding unit and said impregnation tank.

3. The apparatus of claim 1, wherein said impregnation tank includes a support that is mounted on top of said impregnation tank and that has two hanging arms extending downward, and a carrier hung on said hanging arms and extending into said impregnation tank, said conveying roller assembly including a draw roll attached to said carrier and proximate to an upstream side of said impregnation tank, a pair of squeeze rolls attached to said carrier and proximate to a downstream side of said impregnation tank, and a series of immersing rolls attached to said carrier between said draw roll and said squeeze rolls.

4. The apparatus of claim 1, wherein said thermal forming unit includes a pre-forming device, a main forming device disposed downstream of said pre-forming device, and a plurality of said forming channels which are aligned with each other, the pre-forming device including a pair of upper and lower forming rollers defining therebetween one of said forming channels, said main forming device including a pair of upper and lower mold halves defining therebetween another one of said forming channels.

5. The apparatus of claim 4, wherein said pre-forming device further includes a pair of upper and lower heaters to heat said upper and lower forming rollers, respectively, said main forming device further including a plurality of heating elements to heat said upper and lower mold halves.

6. The apparatus of claim 4, wherein the thermal forming unit further includes a post-forming device disposed downstream of said main forming device, the post-forming device having a plurality of pairs of upper and lower mold halves, an upper heater to heat said upper mold halves of said post-forming device, and a lower heater to heat said lower mold halves of said post-forming device, each pair of said upper and lower mold halves of said post-forming device defining therebetween still another one of said forming channels.

7. The apparatus of claim 1, further comprising a cutting section disposed downstream of said thermal forming section, and includes a cutter and a pair of advancing rollers.

* * * * *